US005768151A

United States Patent [19]

Lowy et al.

[11] Patent Number: 5,768,151

[45] Date of Patent: Jun. 16, 1998

[54] SYSTEM FOR DETERMINING THE TRAJECTORY OF AN OBJECT IN A SPORTS SIMULATOR

[75] Inventors: Martin Lowy; Christopher Lowy, both of Scarsdale, N.Y.

[73] Assignee: Sports Simulation, Inc., Pleasantville, N.Y.

[21] Appl. No.: 388,518

[22] Filed: Feb. 14, 1995

[51] Int. Cl.[6] ..... G06F 19/00

[52] U.S. Cl. ..... 364/550; 348/157; 273/317.1; 364/565

[58] Field of Search ..... 364/550, 449, 364/410, 559, 565; 273/118 R–119 R, 317.1–317.6; 356/28.5; 473/150–156; 348/153–157, 169

[56] References Cited

U.S. PATENT DOCUMENTS

| | | | |
|---|---|---|---|
| 3,091,466 | 5/1963 | Speiser | 273/184 |
| 3,508,440 | 4/1970 | Murphy | 73/379 |
| 3,598,976 | 8/1971 | Russell et al. | 235/151 |
| 4,063,259 | 12/1977 | Lynch et al. | 354/120 |
| 4,086,630 | 4/1978 | Speiser et al. | 364/410 |
| 4,136,387 | 1/1979 | Sullivan et al. | 364/410 |
| 4,158,853 | 6/1979 | Sullivan et al. | 358/93 |
| 4,160,942 | 7/1979 | Lynch et al. | 350/120 |
| 4,278,095 | 7/1981 | Lapeyre | 128/689 |
| 4,545,576 | 10/1985 | Harris | 364/411 |
| 4,751,642 | 6/1988 | Silva et al. | 364/413 |
| 4,767,121 | 8/1988 | Tonner | 273/185 A |
| 4,858,934 | 8/1989 | Ladick et al. | 273/186 A |
| 4,915,384 | 4/1990 | Bear | 273/26 R |
| 4,919,536 | 4/1990 | Kominc | 356/28.5 |
| 5,229,849 | 7/1993 | Pleass et al. | 356/28.5 |
| 5,235,513 | 8/1993 | Velger et al. | 364/449 |
| 5,290,037 | 3/1994 | Witler et al. | 273/184 R |
| 5,342,054 | 8/1994 | Chang et al. | 273/186.1 |
| 5,354,063 | 10/1994 | Curhod | 273/185 B |
| 5,393,974 | 2/1995 | Jee | 250/221.1 |
| 5,398,936 | 3/1995 | Klutz et al. | 273/185 B |
| 5,401,018 | 3/1995 | Kelly et al. | 273/26 E |
| 5,401,026 | 3/1995 | Eccher et al. | 273/184 R |
| 5,413,345 | 5/1995 | Nauck | 273/185 R |
| 5,443,260 | 8/1995 | Stewart et al. | 273/26 R |
| 5,471,383 | 11/1995 | Gobush et al. | 364/410 |

*Primary Examiner*—James P. Trammell
*Attorney, Agent, or Firm*—Kalow, Springut & Bressler; Milton Springut

[57] ABSTRACT

A computerized system determines the trajectory of an object based upon video images captured by cameras at two fixed viewpoints. Two video cameras are arranged so that each will contain the anticipated trajectory of an object within its field of view. The video cameras are synchronized and have shutter speeds slow enough to yield an image of the object containing a blur due to the object's motion. An audio or an optical trigger, derived either from the event causing object motion or from the object itself, causes at least two images to be captured in digital frame buffers in a computer. Software in the computer accesses each of the digital frame buffers and subtracts the background image to isolate the blurred object. A two-dimensional projection of the object's trajectory is derived for each frame buffer image. The two dimensional trajectories are combined to determine a three dimensional trajectory.

10 Claims, 6 Drawing Sheets

SYSTEM FOR DETERMINING THE TRAJECTORY OF AN OBJECT IN A SPORTS SIMULATOR

BACKGROUND OF THE INVENTION

1. Field of Invention

This invention, generally, relates to the tracking of moving objects and, more particularly, to a new and improved system for determining the trajectory of an object traveling through the air unattached, such as a ball.

There is a long standing problem connected with determining the trajectory of an object using optical measurements made remotely. Historically, the problem includes the determination of the paths of celestial objects from data collected by telescopes.

In recent times, the paths of aircraft and missiles have been determined by triangulating multiple lines of sight using optical instruments that measure relative angles, much like a surveyor's transit. An optical means of determining the trajectory of an object has the advantage that the object being tracked does not have to be equipped with a transponder, as does a radio frequency system.

Optical tracking, therefore, is especially appropriate for tracking small objects, such as a ball used in sports. Tracking a sports ball is needed for assessing athletic performance or for building an interactive sports simulator. Interactive sports simulators use real player equipment, but they simulate the playing field or other environment so that an individual can play indoors in a relatively small space.

In a sports simulator, the trajectory of the real ball, which is struck or thrown by the player, must be determined, so that the completion of trajectory may be simulated in a projected image and the performance of the player can be indicated. In a game or in a sports simulator, cost of the tracking device must be minimized, and the space for placing the instruments must be constrained.

In a constrained space, the tracking device must be able to keep up with high angular rates of the ball. Both cost and angular rate pose serious limitations to the use of present day optical and other tracking devices for a sports application.

2. Description of the Prior Art

An alternative to optical tracking is to place a light source, such as a light emitting diode (LED), on the object to be tracked and to observe the light source with multiple video cameras.

An example of prior efforts would be U.S. Pat. No. 4,751,642 and U.S. Pat. No. 4,278,095. However, the size and fragility of the LED and its power source make these prior efforts unsuitable for small objects launched by striking, such as a baseball or golf ball.

The trajectory of the struck ball is determined in some golf simulators by measuring parameters of the ball's impact with a surface. In these golf simulation systems, the essential element is a contact surface which allows a system to capture data at the moment of impact. Such a surface usually is equipped with electromechanical or photocell sensors.

When a surface impacts with a ball, data captured by the sensors is connected to electrical circuits for analysis. Examples are U.S. Pat. No. 4,767,121; U.S. Pat. No. 4,086,630; U.S. Pat. No. 3,598,976; U.S. Pat. No. 3,508,440; and U.S. Pat. No. 3,091,466.

The electromechanical nature of a contact surface makes it prone to failure and to miscalibration. Frequent physical impacts on the surface tend to damage the sensors, and failure or miscalibration of a single sensor in an array of sensors covering the surface can seriously degrade system accuracy.

Abnormalities in a stretched contact surface, such as those produced by high speed impacts, also can produce results that are misleading. Furthermore, the applications of an impact sensing system are limited.

Limitations include the requirement to fix the source of the ball at a predetermined distance; limited target area; and insensitivity to soft impacts. While these limitations permit fairly realistic golf, generally they are not useful in playing other sports.

Another trajectory determination technique used in golf simulators is based on microphones sensing the sounds of both a club-to-ball contact and a surface-to-ball contact.

With this technique, microphones are placed in four or more locations around the surface so that their combined inputs can measure the point at which the ball surface is hit. Based on the speed of sound, the relative timing of audio events at each microphone provide enough data to allow a computer to derive ball speed and trajectory.

This approach may be less prone to electromechanical failure, but it still has its limitations. The limitations of an audio system include the need for at least three channels (having four is preferred), relative insensitivity to soft (low speed) impacts, and sensitivity to other noise sources.

Finally, a limited field of play results from the requirement that a surface impact the ball between the measurement devices in a recognizable way. This implies a "target area", with consequent installation constraints similar to those of the surface sensors outlined in the first system above.

When a microphone is used to initiate operation of a picture taking device, the data captured by the microphone are used for triggering purposes only and are not requisites in the determination of the trajectory of an object in motion. Some golf simulators also calculate ball spin by reflecting a laser beam off a mirror located on a special golf ball designed specifically for that purpose.

The ball must be placed in a particular position prior to being hit with the mirror facing a laser and receiver array. The laser beam's reflection is sensed by a receiver array, and on impact, the motion of the beam is used to determine ball spin.

This technology provides data which augments the basic data of speed and trajectory. However, it also requires the use of a special ball and additional equipment.

In non-golf sports simulation systems, a similar contact surface arrangement is used to measure trajectory, distance, velocity and accuracy of a performance. Examples are U.S. Pat. No. 4,915,384; and U.S. Pat. No. 4,751,642.

In one system, a player bats against a pitching machine that is controlled by a computer. The results of the player's actions are captured on a screen located at a distance away. Data relating to locations of contact on the screen are analyzed by the computer.

Depending on the results of the analysis, the computer will adjust the pitching machine to an appropriate level of play to conform to the skills of the player. The results of a player's performance are not displayed visually and are only reflected through the operation of the pitching machine. U.S. Pat. No. 4,915,384 discloses an example of this system's operation.

In areas of non-sports activities where captured video images are used in the tracking of objects in motion, no such images have been utilized to determine speed and trajectory of an object without the aid of additional devices, other than a computer. Examples are described in U.S. Pat. No. 4,919,536; U.S. Pat. No. 5,229,849; and in U.S. Pat. No. 5,235,513.

In one instance, a system is arranged to guide aircraft for automatic landing based on the tracking and monitoring of their motions. Such tracking and monitoring, however, are accomplished with additional equipment which emit and exchange optical signals. U.S. Pat. No. 5,235,513 describes such a system.

While all of the systems presently known, as described above, are effective for their purpose, they provide little information that is helpful for tracking and/or monitoring a moving object of far less significance, such as in a sports simulator. In this type of apparatus, cost is an important consideration, and yet, it is not the only factor involved. A system, as hereinafter described, must be reliable and sufficiently accurate to be useful but not so complex as to make it cost prohibitive.

OBJECTS AND SUMMARY OF THE INVENTION

It is an object of the present invention to provide an economical, reliable and accurate system to track and monitor an object in motion that is particularly adaptable for use in sports simulation apparatus.

It is also an object of the invention to provide a reasonably accurate system for indicating the trajectory of an object in motion that is sufficiently cost effective to permit use in games and sports simulators.

A further object of the invention is to provide a system that is economical and sufficiently accurate in indicating trajectory of a moving object for sports simulation equipment.

Briefly, in a system that is constructed and arranged in accordance with the principles of the present invention, a video camera is supported on each side of an expected path of an object. Video signals of the view of the object in motion are fed to frame grabbers, where digital frames of the object from each video camera are produced and stored. These images have a blur which represents the object's path of motion for the period of capture (typically one sixtieth of a second). The first frames from the frame grabbers are used by an image data processor as reference frames which are subtracted digitally from latter frames, resulting in isolation of the blur. Then, all later captured images are processed according to a series of algorithms to produce a line that characterizes the object's trajectory.

DETAILED DESCRIPTION OF THE PREFERRED EMBODIMENT

Figure 1:
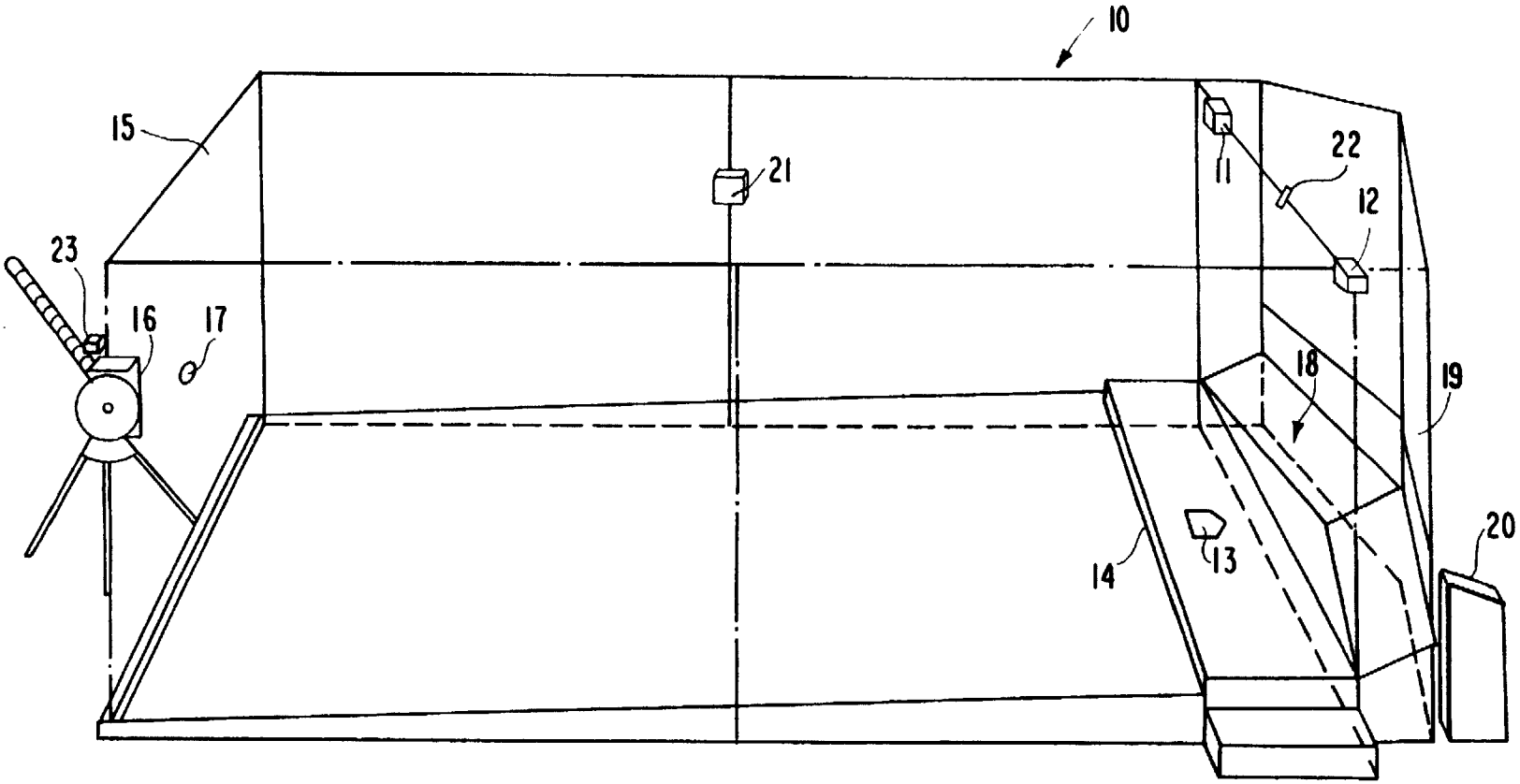
FIG. 1 is a perspective diagrammatic view illustrating a baseball simulation system with component parts arranged in accordance with the principles of the present invention.

As illustrated in FIG. 1 of the drawings, the system 10 for determining the trajectory of a moving object includes video cameras 11 and 12 supported to take images of an object in motion along an anticipated path. While the system 10 of the invention may be used in connection with different forms of game simulators, it will be described as it is used in an actual baseball batting simulator in which a person will stand on either side of a "home plate" 13.

A player standing at "home plate" 13 and looking will see a view of a baseball field, as it would be visible in an actual ball park, and this view is obtained by projecting such a scene from a projector 14 to a screen 15. A baseball throwing device 16 is located behind the screen 15 to throw balls through an a hole 17 in the screen 15.

An actual and realistic arrangement is constructed behind the home plate to simulate a baseball environment, which includes a bench 18 and a scene on a back drop 19 that can be anything realistic, such as a view of a dugout or a view of spectators. A console 20 is located in a suitable position with the switches, buttons and such devices to control operations of the system 10.

The operating sequence of the system 10 is initiated after the respective components are calibrated, a process that will be described in detail presently. A video camera 21 is supported over the system 10, as shown in FIG. 1, for use in this procedure.

After the system is calibrated, operation is initiated, to determine the trajectory of the baseball that is hit, by the sound of the baseball being hit, and this sound is detected by a microphone 22.

In accordance with the invention, the microphone 22 is not operable until it is armed, and therefore, an infrared detector 23 on or near the baseball throwing device 16 senses when a ball passes. A signal from the detector 23 is connected to "arm" (i.e., to render "ready") and to render the microphone 22 active.

Results of operating the system 10 of the invention can be used in any manner desired, which can be available on the console 20, and having the following detailed description, it is believed that such use will be clear. An example of such use of the baseball trajectory resulting signals is a video display that is a part of the console 20 (not visible).

The two video cameras 11 and 12 are located in front of and on the sides of an anticipated trajectory. Signals from these video cameras 11 and 12 are connected to a video frame grabber 25, which is a component part of a data processor 26.

A frame grabber is a device for developing and storing a single image from a sequence of video images or frames, and usually, it is a circuit card that plugs into an image processor to convert the video image into a rectangular array of pixels, with each pixel a digital value representing the brightness or color of the image at that point in the array.

The image processor 26, which is a Central Processing Unit (CPU), is connected with the frame grabber 25 and accesses the stored data in the frame grabber pixel-by-pixel for analysis, according to algorithms to be described hereinafter.

A suitable video camera is a Sony DXC-151A CCD Color Video camera, which includes means for synchronizing to other cameras and video equipment. A suitable frame grabber is the ComputerEyes/Pro Video Digitizer manufactured by Digital Vision, Inc. A suitable image processor to function as the CPU is the Gateway Model P5-90, an IBM compatible personal computer.

Figure 2:
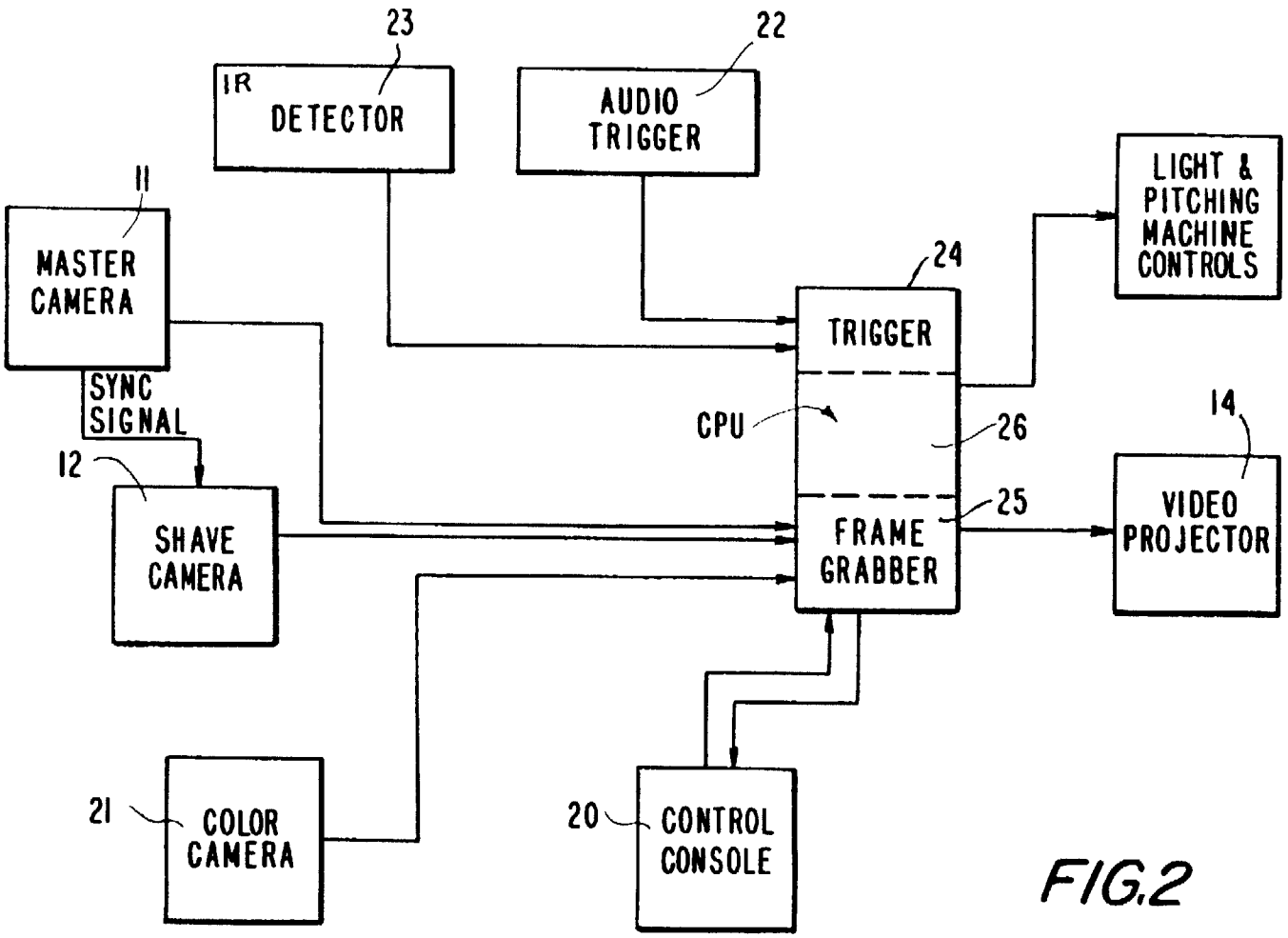
FIG. 2 is schematic diagram illustrating how the component parts of FIG. 1 are connected in accordance with the principles of the present invention.

Referring next to FIG. 2 of the drawings, the interconnection of the component parts described above will be described. The system 10 has the image processor 26 as its central component, and the frame grabber 25 is a part of that component.

Detecting when the bat hits the ball is done with a signal from the microphone 22 after it is armed by the IR detector 23. In accordance with the preferred embodiment, the image processor 26 is not armed until the ball is pitched, thus eliminating the possibility of extraneous apparent hits.

The trigger mechanism, within the CPU 26, is activated when the sound level from the microphone 22 exceeds a predefined threshold. However, by using more sophisticated digital signal processing, trigger activation may be more finely tuned to the actual event. Immediately after the sound trigger, when the object is in both camera views, video images are taken by the video cameras and captured by the frame grabber.

Analysis of the data is performed by the CPU to determine the trajectory of the hit ball. In principle, any number of pairs of frames may be grabbed and analyzed while the object is within the field of view of the cameras, subject to camera shutter speed and frame grabber time interval limitations.

The following is a more detailed description of how the analysis is performed:

The process of determining the trajectory of the object, in accordance with the present invention, includes these steps:

(1) calculation of two dimensional trace;

(2) calibration of video camera field of view;

(3) conversion from frame grabber coordinates to camera coordinates; and (4) calculation of the object's location in space.

These will be described in more detail now.

(1) Calculation of a two Dimensional Trace.

The frame grabber 25 captures the images at a rate of 60 Hz, or such other rate as may be suitable to the particular installation. In a baseball embodiment, a resolution of 256×256 pixels is sufficient to provide accuracy for subsequent calculations.

Just before each ball is pitched, reference images are captured from each of the video cameras and stored for subsequent calculations. This action is initiated by the IR detector 23 rendering the microphone 22 sensitive, within the CPU 26. After a ball is hit, images containing the ball in motion are captured simultaneously by both video cameras 11 and 12. Each reference image pixel is subtracted from the corresponding pixel in the image containing the ball.

If the result of this subtraction exceeds a specified threshold, it is considered a potential ball pixel. Once all of the "potential ball pixels" are identified, those pixels are grouped by proximity, that is, pixels "touching" each other are grouped together.

Finally, the group with the most pixels is assumed to be the trace left behind by the moving ball. A camera shutter speed of 1/60th second is used in order to intentionally cause the moving ball to leave an elongated trace (or blur) in the resulting frame grabber image.

Faster balls create a longer trace than slower balls. It has been discovered that the difference in trace lengths between slow and fast balls (20 to 80 miles/hr) (32.18 to 128.72 km/hr) is typically 50 to 80 pixels (given a camera shutter speed of 1/60th of a second).

Therefore, resolution is calculated by dividing speed range by trace length range. The two dimensional line of a given trace is obtained by calculating a line of best fit which passes through the group of ball pixels.

The following logic is used to calculate the line of best fit for a given set of "n" points $P_1(X_1,Y_1)$, $P_2(X_2,Y_2)$, . . . , $P_3(X_3,Y_3)$. First, calculate the following values:

$$X_{avg}=(X_1+X_2+\ldots+X_n)/n$$

$$Y_{avg}=(Y_1+Y_2+\ldots+Y_n)/n$$

$$m=\frac{(X_1Y_1+X_2Y_2+\ldots+X_nY_n)-nX_{avg}Y_{avg}}{(X_1^2+X_2^2+\ldots+X_n^2)-nX_{avg}^2}$$

Then, the sought line of best fit is given by:

$$Y-Y_{avg}=m(X-X_{avg})$$

By putting all ball pixel coordinates into this equation, the equation coefficients are obtained for a line that cuts the trace in the direction of elongation. By identifying the ball's center at both ends of the trace, a two dimensional line segment (one for each image) is obtained, which represents the ball's movement while the camera shutter was open.

Figure 3:
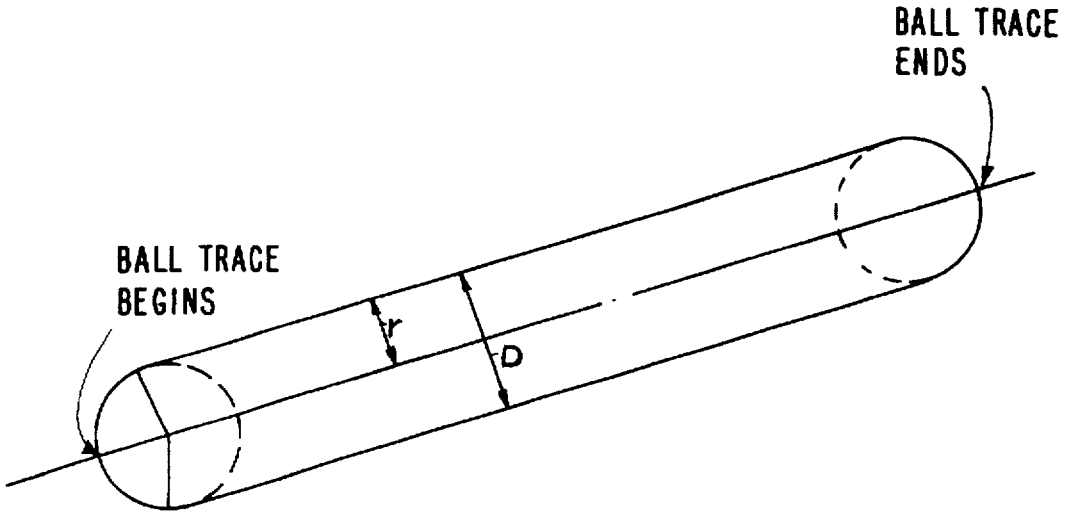
FIG. 3 is a diagram illustrating the area of interest in gathering data within the video image range of an object in motion for the purposes of the invention.

Referring now to FIG. 3, to find the center of the ball at either end of the trace, the approximated radius of the ball is calculated first and, then, used as an offset distance from the extreme ends of the trace. The approximated radius is found by counting pixels starting at the center of the trace (found by averaging the two extreme end points) and traveling perpendicularly outward from the best fit line.

The number of pixels counted is an approximation of the trace width (or the ball's diameter in frame grabber pixels) and dividing the trace width by two then yields an approximate radius. Using this value as a distance offset from the extreme end points of the trace yields an excellent approximation of the ball's center at either end of the trace.

(2) Calibration of Video Camera Field of View.

Before the two dimensional line segments can be used to determine ball speed and trajectory, the exact field of view (FOV) of the frame grabbed image must be determined, both horizontally and vertically. The FOV may be asymmetrical, either horizontally or vertically, so that the center of the frame grabber coordinate system is at the center of the camera's view.

Figure 4:
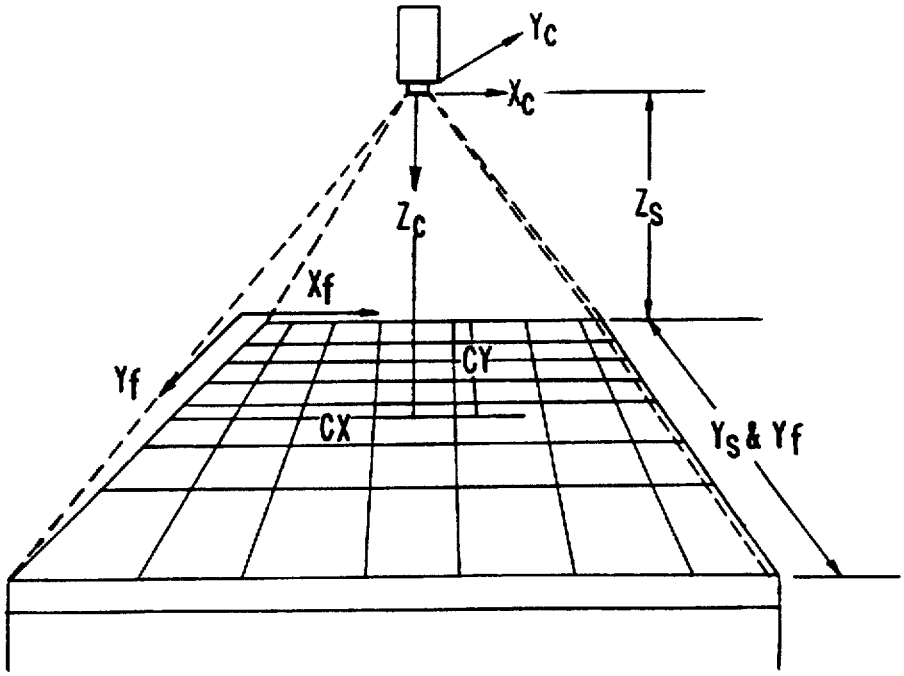
FIG. 4 is a diagram illustrating means used to empirically determine the actual field of view of a video camera to achieve the accuracy available in the system of the invention.

Referring to FIG. 4, the calibration technique requires that the video camera 21 be movable straight up and down. Graph paper is placed perpendicular to the video camera's view such that it may be moved forward or backward along the camera's "z" axis, and left or right along the camera's "x" axis.

The graph paper is adjusted so that the upper left of the graph paper is in the extreme upper left of the video camera's view, while the video camera height is adjusted so that the graph just fills the FOV. Once these adjustments have been made, the values of $X_s$, $Y_S$, $Z_S$ and $X_f$, $Y_f$ (in two dimensional frame grabber coordinates) are obtained directly, with the "s" coordinates representing the camera coordinates and the "f" coordinates representing the frame grabber coordinates.

Finally, by extending a line straight from the center of the video camera lens to the surface of the graph paper, the values of $C_X$, $C_Y$ are measured, as seen in FIG. 4. Based upon these values, the actual FOV of the frame grabbed image is calculated as follows:

$$\text{Horizontally: } FOV_H=2A\tan(C_X/Z_S) \quad (1)$$

$$\text{Vertically: } FOV_V=2A\tan(C_Y/Z_S) \quad (2)$$

(3) Coordinates Conversion from Frame Grabber to Camera.

Figure 5:
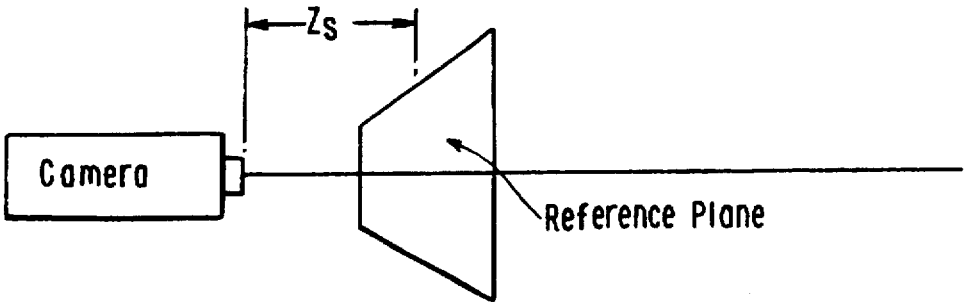
FIG. 5 is a diagram illustrating a relationship between a reference plane and a video camera to obtain coordinate conversion, as an aid in the description of the invention.

FIG. 5 shows a reference plane positioned directly in front of the video camera, at a distance of $Z_S$, and perpendicular to its line of sight. The conversion from frame grabber coordinates to camera coordinates (in the reference plane) is obtained as follows:

Determine length per frame grabber pixel:

$$dx=X_s/X_f \ldots \text{constant} \quad (3)$$

$$dy=Y_s/Y_f \ldots \text{constant} \quad (4)$$

Letting $F_X$,$F_Y$ represent a raw frame grabber location, the corresponding reference point in camera coordinates, $P_C$ ($X_C$, $Y_C$, $Z_C$), is determined as follows:

$$X_C=(F_X*dx)-C_X \quad (5)$$

$$Y_C=C_Y-(FY*dy) \quad (6)$$

$$Z_C=Z_S \ldots \text{constant} \quad (7)$$

The camera parameters now have been measured, and the logic of the ball detection, in raw two dimensional frame grabber coordinates, is complete.

The next step is derivation of the core technical algorithm, which is calculation of the ball's location in space based upon camera location and orientation and the two dimensional frame grabber inputs.

(4) Calculation of the Object's Location in Space.

The mathematical solution described here is flexible enough to allow two video cameras to be mounted virtually anywhere in space and at any orientation, provided they capture adequate pictures of the ball in flight from two different vantage points. The mathematical solution, therefore, makes no assumptions about camera location or orientation, with the exception that roll for both video cameras will always be zero.

The basic coordinate systems, for the various calculations, are described as follows.

Figure 6:
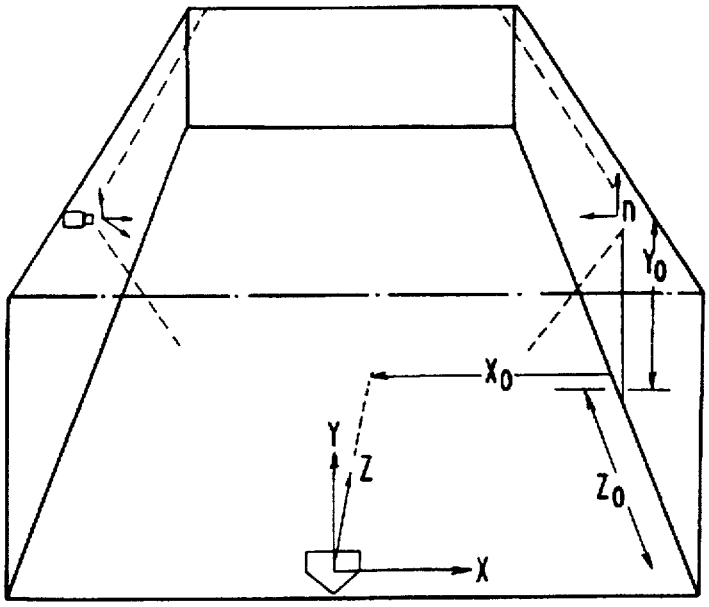
FIG. 6 is a three-dimensional diagram illustrating a system of various coordinates as an aid in describing the invention.

FIG. 6 shows a typical camera positioning arrangement with all coordinate axes shown and labeled appropriately. To define camera orientation, the direction of the camera in a horizontal plane, referred to as "yaw", is obtained by letting zero yaw indicate that the camera is facing straight ahead; by letting positive yaw indicate facing to the left; and by letting negative yaw indicate facing to the right. Let $Y_L$ and $Y_R$ indicate the yaw of the left camera and the right camera, respectively.

Figure 7:
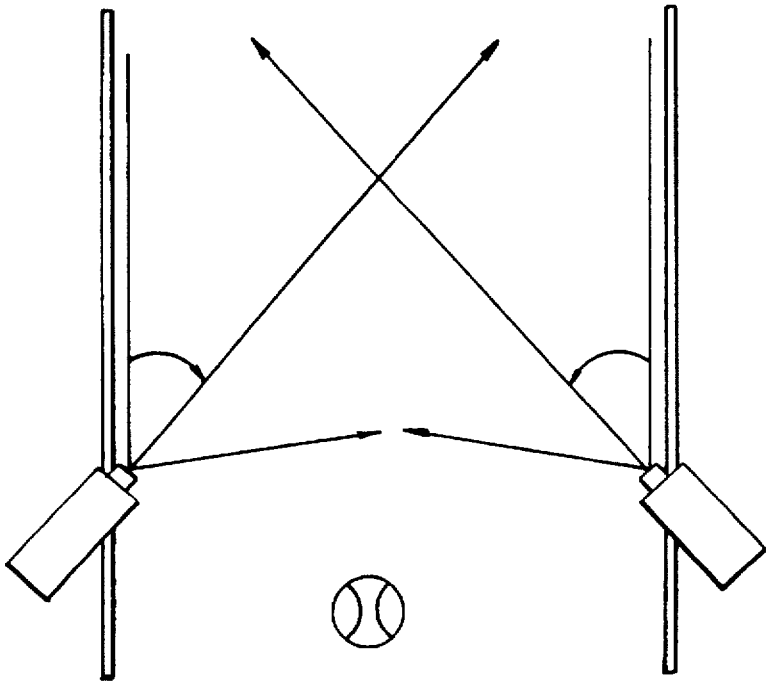
FIG. 7 is a plan view illustrating a camera orientation as a further aid in describing the invention.
Figure 8:
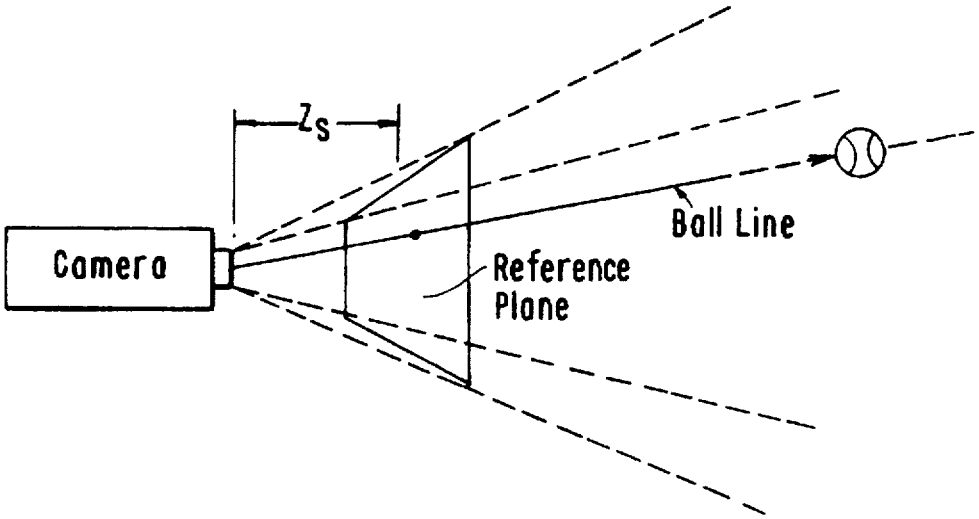
FIG. 8 is a diagram of an object line of sight relative to a reference plane as viewed by a video camera.

FIG. 7 illustrates this naming convention. For this embodiment, camera yaw is set to half the camera's horizontal FOV. Similarly, orientation of the cameras in a vertical plane is referred to as pitch, and camera pitch is set to half the camera's vertical FOV. This is illustrated in FIG. 8, where $P_L$ and $P_R$ represent pitch of the left and right cameras, respectively.

With camera locations and orientations defined symbolically, the mathematical solution to determine the ball's location in "ball coordinates" is determined based upon two known quantities:

(1) the line in camera #1 coordinates that pierces the ball; and (2) the line in camera #2 coordinates that pierces the ball.

It should be understood that, mathematically, these two lines will most likely not actually intersect. Therefore, the solution described here cannot simply calculate the point of intersection of two lines in space.

The next step is to find the point of the shortest perpendicular distance between the two lines. This, however, is time consuming requiring, for example, successive approximations.

Therefore, in the preferred embodiment of the invention, the solution used is described as follows: from one of the images, approximate a line in space on which it is known that the ball must lie at an assumed point. From the other image, derive a vertical plane in space in which it is known that the ball's center exists. Where the line and the plane intersect is where the ball is actually located in space.

To accomplish this, in accordance with the invention, the ball location in camera coordinates first must be converted to a common coordinate system. This conversion requires two basic steps: one, rotational alignment and, two, translational alignment.

The location of the two cameras in ball coordinates is found by direct inspection of FIG. 6. Letting $P_{o1}$ and $P_{o2}$ denote the point of origin for camera #1 and camera #2 yields:

Camera #1 location=$P_{o1}$=$-X_M$, $Y_M$, $Z_M$

Camera #2 location=$P_{o2}$=$X_M$, $Y_M$, $Z_M$

As stated hereinabove, roll for both cameras, i.e., rotation about the "z" axis in camera coordinates is zero by definition. In matrix form, orientation of either camera may be represented as follows. Rotational alignment is performed by multiplying a given 1×3 vector, i.e., the ball location in camera coordinates, by the resultant 3×3 matrix.

Letting $P_C$ ($X_C$, $Y_C$, $Z_C$) represent a point in camera coordinates yields a translational alignment that requires adding the cameras' locations in ball coordinates. The full transformation from camera coordinates to ball coordinates becomes:

For camera #1: Let PC1 ($X_{C1}$, $Y_{C1}$, $Z_{C1}$) be a given location in camera #1 coordinates. $P_{B1}$ represents the same location in ball coordinates, as follows:

$$X_{B1}=X_{C1}\mathrm{Cos}Y_L+Y_{C1}\mathrm{Sin}P_L\mathrm{Sin}Y_L-Z_{C1}\mathrm{Cos}P_L\mathrm{Sin}Y_L+X_M \quad (8)$$

$$Y_{B1}=Y_{C1}\mathrm{Cos}P_L+Z_{C1}\mathrm{Sin}P_L+Y_M \quad (9)$$

$$Z_{B1}=X_{C1}\mathrm{Sin}Y_L-Y_{C1}\mathrm{Sin}P_L\mathrm{Cos}Y_L+Z_{C1}\mathrm{Cos}P_L\mathrm{Cos}Y_L+Z_M \quad (10)$$

For camera #2: Let $P_{C2}$ ($X_{C2}$, $Y_{C2}$, $Z_{C2}$) be a given location in camera #2 coordinates. $P_{B2}$ represents the same location in ball coordinates, as follows:

$$X_{B2}=X_{C2}\mathrm{Cos}Y_R+Y_{C2}\mathrm{Sin}P_R\mathrm{Sin}Y_R-Z_{C2}\mathrm{Cos}P_R\mathrm{Sin}Y_R+X_M \quad (11)$$

$$Y_{B2}=Y_{C2}\mathrm{Cos}P_R+Z_{C2}\mathrm{Sin}P_R+Y_M \quad (12)$$

$$Z_{B2}=X_{C2}\mathrm{Sin}Y_R Y_{C2}\mathrm{Sin}P_R\mathrm{Cos}Y_R+Z_{C2}\mathrm{Cos}P_R\mathrm{Cos}Y_R+Z_M \quad (13)$$

As shown in FIG. 8, these three dimensional reference points define lines in camera coordinates that start at the focal point of the camera and extend through the reference point, as shown below. This line is referred to hereinafter as a "ball line".

Considering the ball line for a single camera, the next step is to determine at what point along this line the ball actually exists. To solve this problem, an arbitrary variable "t" is used, which may vary from 0 to 1.0 between the focal point and the reference point, as shown in FIG. 8.

Points along the ball line are defined in terms of "t", as follows:

$$P(t)=At+B$$

"A" and "B" are constant coefficients which are determined readily since two points on the line are known already:

$$\text{When } t=0 \ldots P(0)=P_0=A(0)+B,\ B=P_0$$

$$\text{When } t=1 \ldots P(1)=P_B=A(1)+B,\ A=P_B-B=P_B-P_0$$

Therefore, . . . $P(t)=(P_B-P_0)t+_0$. Expanding for the three coordinate axis yields:

$$X(t)=At+B \tag{14}$$

$$Y(t)=Ct+D \tag{15}$$

$$Z(t)=Et+F \tag{16}$$

Where:

$$A=X_B-X_0 \text{ and } B=X_0$$

$$C=Y_B-Y_0 \text{ and } D=Y_0$$

$$E=Z_B-Z_0 \text{ and } F=Z_0$$

Figure 9:
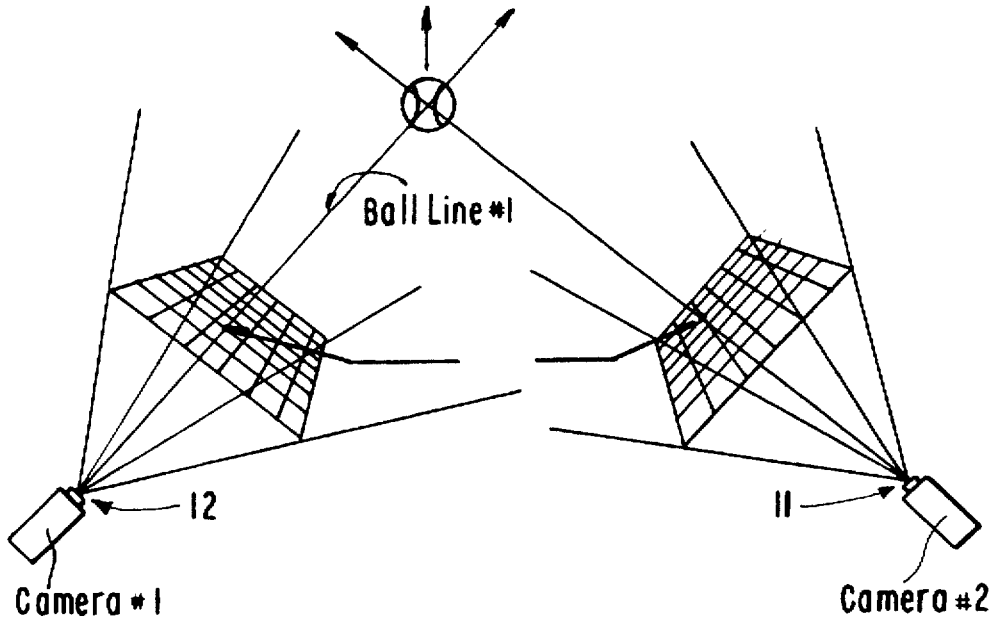
FIG. 9 is an illustration of the relationship between a camera's line of sight to an object and a vertical plane created by a second camera's line of sight to the same object.

The above calculations are used to define the ball line of camera #1 in terms of "t", and the information from camera #2 is used to define a vertical plane containing its reference point, which cuts the ball line extending from camera #1. This is shown in FIG. 9.

Solving for the value of "t" at this point of intersection and substituting that value into Equations 14, 15 and 16, yields the ball location in ball coordinates.

In order to define the vertical plane containing the reference point of camera #2, three points that lie in the plane are needed.

These points are:

(1) the point of origin for camera #2 ($P_{o2}$).

(2) the reference point converted to ball coordinates ($P_{R2}$), and (3) a point directly below $P_{o2}$ called $P_3$, which is obtained by setting $Y_{o2}$ to zero.

Traditionally, a three dimensional plane equation has the general form:

$$Ax+By+Cz+D=0 \tag{17}$$

All three of the points described above represent solutions to this plane equation. Therefore, the points are considered as a set of three simultaneous equations. In matrix form, using $[X_1,Y_1,Z_1]$, $[X_2,Y_2,Z_2]$ $[X_3,Y_3,Z_3]$ to symbolically represent any three points in general, yields coefficients of the general plane equation (17) that now are found by direct inspection of the equations above as follows:

$$A=Y1(Z_3-Z_2)+Y_2(Z_1-Z_3)+Y_3(Z_2-Z_1)$$

$$B=X1(Z_2-Z_3)+X_2(Z_3-Z_1)+X_3(Z_1-Z_2)$$

$$C=X1(Y_3-X_1Y_2+X_2Y_1-X_2Y_3-X_3Y_1+X_3Y_2$$

$$D=X_1Y_2Z_3-X_1Y_3Z_2-X_2Y_1Z_3+X_2Y_3Z_1+X_3Y_1Z_2-X_3Y_2Z_1$$

Given equation (17), substitute equations (14), (15) and (16) for the values of X, Y, and Z, respectively:

$$a(At+B)+b(Ct+D)+c(Et+F)+d=0$$

Expanding this equation yields:

$$aAt+aB+bCt+bD+cEt+cF+d=0$$

Solving for "t" yields:

$$t=\frac{-(aB+bD+cF+d)}{aA+bC+cE}$$

At this point, the values of a, b, c, d and A, B, C, D, E, F are known, and the value of "t" is readily calculated. Substituting this value of "t" in equations (14), (15) and (16) yields the point of intersection between the camera #1 ball line and the camera #2 vertical plane in ball coordinates.

Now all information needed to determine the ball's speed and trajectory at the time the images were grabbed is available. Based on the two pictures of the ball, a two dimensional line segment is obtained (one for each image), which accurately represents the ball's travel in two dimensional frame grabber coordinates.

By using the above described method to obtain a ball line and vertical plane intersection on the ball's starting points and, then, on its end points, the corresponding start and end point in three-dimensional ball coordinates are calculated. Speed is obtained by calculating the length of the trace in ball coordinates and, then, dividing it by the length of time the camera shutter was open.

The entire process for the above described calculations takes less than one quarter (0.25) second.

While the invention has been described in substantial detail, it is understood that changes and modifications may be made without: departing from the true spirit and scope of the invention. Also, it is understood that the invention can be embodied in other forms and for other and different purposes. Therefore, it is understood equally that the invention is limited only by the following claims.

What is claimed is:

1. A system for measuring the trajectory of a moving ball or sport projectile and providing data on its trajectory automatically, comprising:

a plurality of picture taking means for capturing images of the ball or sport projectile in motion;

trigger means for activating said picture taking means to capture images of said ball or sport projectile in motion wherein said trigger means includes:

means for detecting sound means for analyzing output from said means for detecting sound and for determining whether the picture taking means should be activated; and means for connecting said means for detecting sound to said means for analyzing output from said means for detecting sound;

frame grabber means for receiving images captured by said picture taking means, and for producing digital reference frames;

means for connecting said picture taking means to said frame grabber means;

data processor means for receiving said digital reference frames from said frame grabber means and for determining speed and trajectory of said ball or sport projectile; and means for displaying sequences of play which includes projection apparatus means.

2. A system according to claim 1 wherein said means for detecting sound includes microphone means.

3. A system according to claim 1 wherein said means for analyzing output from said means for detecting sound and for determining whether the picture taking means should be activated includes digitizer means.

4. A system for measuring the trajectory of a moving ball or sport projectile and providing data on its trajectory automatically, comprising:

a plurality of picture taking means for capturing images of the ball or sport projectile in motion;

trigger means for activating said picture taking means to capture of said ball or sport projectile;

frame grabber means for receiving images captured by said picture taking means, and for producing digital reference frames;

means for connecting said picture taking means to said frame grabber means;

data processor means for receiving said digital reference frames from said frame grabber means and for determining speed and trajectory of said ball or sport projectile; and means for tracking a player's physical movements which comprises computer monitored helmet means adapted to be worn by a player or user of said system and an overhead camera supported in a predetermined location vertically over a path anticipated to be taken by said ball or sport projectile for capturing a third image of said ball or sport projectile.

5. A system for measuring the trajectory of a moving ball or sport projectile and providing data on its trajectory automatically, comprising:

a plurality of video camera means for capturing images of the ball or sport projectile in motion;

trigger means for activating said video camera means to capture images of said ball or sport projectile in motion;

frame grabber means for receiving images captured by said video camera means, and for producing digital reference frames which form a blur of said ball or sport projectile;

means for connecting said video camera means to said frame grabber means; and data processor means for receiving said digital reference frames from said frame grabber means and for determining speed and trajectory of said ball or sport projectile from said digital frames of said blur.

6. A system according to claim 5 wherein said video camera means has a shutter with a speed sufficiently slow to yield said blur of said ball in motion.

7. A system according to claim 6 including trigger means for initiating operation of said video camera means, said video camera means produces at least two images in said frame grabber means spaced apart forming definition of a beginning and an ending of said blur.

8. A system according to claim 6 including at least two frame grabber means, one connected with each of at least two video camera means, two of said video camera means having shutter speeds synchronized at different speeds to produces images of said ball in motion in the form of a blur, and said data processor means accesses each of said frame grabber means to subtract said images of said ball in motion for isolating said ball in motion and for producing a trajectory of its path.

9. A system for measuring the trajectory of a moving ball or sport projectile and providing data on its trajectory automatically, comprising:

a plurality of picture taking means for capturing images of the ball or sport projectile in motion;

trigger means for activating said picture taking means to capture images of said ball or sport projectile in motion;

frame grabber means for receiving images captured by said picture taking means, and for producing digital reference frames;

means for connecting said picture taking means to said frame grabber means;

data processor means for receiving said digital reference frames from said frame grabber means and for determining speed and trajectory of said ball or sport projectile; and means for displaying sequences of play which includes projection apparatus means.

10. A system according to claim 9 wherein the image data processor means further includes computer means and predetermined software for implementing mathematical algorithms for calculating speed and trajectory of the ball or sport projectile.

* * * * *